US011598084B2

(12) United States Patent
Foley et al.

(10) Patent No.: US 11,598,084 B2
(45) Date of Patent: Mar. 7, 2023

(54) METAL SHEAR CONNECTOR STRUCTURE FOR ADJACENT CONCRETE PANELS

(71) Applicant: CONNECT-EZ, LLC, Harveysburg, OH (US)

(72) Inventors: Robert P. Foley, New Albany, OH (US); Terry J. Tincher, Oregonia, OH (US)

(73) Assignee: Connect-EZ, LLC, Harveysburg, OH (US)

( * ) Notice: Subject to any disclaimer, the term of this patent is extended or adjusted under 35 U.S.C. 154(b) by 0 days.

(21) Appl. No.: 17/160,870

(22) Filed: Jan. 28, 2021

(65) Prior Publication Data

US 2021/0148109 A1 May 20, 2021

Related U.S. Application Data

(63) Continuation-in-part of application No. 29/706,493, filed on Sep. 20, 2019, now Pat. No. Des. 918,019.

(51) Int. Cl.

| | |
|---|---|
| ***E04B 1/41*** | (2006.01) |
| ***E04B 1/04*** | (2006.01) |
| ***E01C 11/02*** | (2006.01) |
| ***E04F 15/14*** | (2006.01) |
| *E04B 1/24* | (2006.01) |
| *E04B 1/38* | (2006.01) |

(52) U.S. Cl.

CPC ..... *E04B 1/4114* (2013.01); *E01C 11/02* (2013.01); *E04B 1/043* (2013.01); *E04F 15/14* (2013.01); *E04B 2001/2415* (2013.01); *E04B 2001/2421* (2013.01); *E04B 2001/405* (2013.01)

(58) Field of Classification Search

CPC ... E04B 1/043; E04B 1/40; E04B 1/41; E04B 1/4114; E04B 5/023; E04B 2001/405; E04B 2001/2415; E04B 2001/2421; E01C 11/02; E01C 11/04; E04F 15/14

See application file for complete search history.

(56) References Cited

U.S. PATENT DOCUMENTS 4,454,703 A 6/1984 Sitzler et al.
5,548,939 A * 8/1996 Carmical ..... E04B 1/4135 52/707

(Continued)

FOREIGN PATENT DOCUMENTS

CN 208831435 U * 5/2019
CN 113175096 A * 7/2021

(Continued)

*Primary Examiner* — Jessie T Fonseca

(74) *Attorney, Agent, or Firm* — Jacox, Meckstroth & Jenkins

(57) ABSTRACT

Adjacent concrete wall panels are connected at the vertical joint by a shear connector structure that includes a metal connector angle embedded in a corner portion of one of the panels, and one or more threaded nuts or studs are welded to a flange of the angle. A metal shear connector plate has a hole for each threaded nut or stud and elongated holes or slots for the other concrete panel. After the panels are erected and positioned, the connector plate is bolted to the studs and self-tapping concrete anchor screws are inserted into the slots and threaded into holes formed in the other panel. The studs are formed by machinery weld studs to form a bore with threads at the welded end of each stud.

9 Claims, 3 Drawing Sheets

(56) References Cited

U.S. PATENT DOCUMENTS

| | | | | |
|---|---|---|---|---|
| D666,078 | S | 8/2012 | Foley et al. | |
| 8,448,397 | B2 | 5/2013 | Tincher et al. | |
| 8,800,232 | B1 * | 8/2014 | Keenan | E04B 1/41 52/125.4 |
| D780,557 | S | 3/2017 | Foley et al. | |
| 9,897,123 | B2 | 2/2018 | Esposito et al. | |
| D811,853 | S | 3/2018 | Foley et al. | |
| 2009/0272066 | A1 * | 11/2009 | Rosenkranz | F16B 5/025 52/700 |
| 2011/0107716 | A1 | 5/2011 | Foley | |
| 2011/0138735 | A1 | 6/2011 | Foley | |
| 2013/0031857 | A1 | 2/2013 | Tincher et al. | |
| 2014/0020321 | A1 * | 1/2014 | Eklund | E04B 1/043 52/582.1 |
| 2020/0208397 | A1 | 7/2020 | Watson | |

FOREIGN PATENT DOCUMENTS

| | | | | | |
|---|---|---|---|---|---|
| JP | H0913514 | A | * | 1/1997 | |
| KR | 101050166 | B1 | * | 7/2011 | |
| KR | 20120038942 | A | * | 4/2012 | |
| KR | 101399926 | B1 | * | 5/2014 | |
| KR | 20170031272 | A | * | 3/2017 | |
| WO | WO-2014111712 | A1 | * | 7/2014 | E01C 11/04 |

* cited by examiner

METAL SHEAR CONNECTOR STRUCTURE FOR ADJACENT CONCRETE PANELS

RELATED APPLICATION

This application is a continuation-in-part of design patent application Ser. No. 29/706,493 and claims the benefit of its filing date of Sep. 20, 2019.

BACKGROUND OF THE INVENTION

The present invention relates to a shear connector structure or system for connecting adjacent concrete wall panels positioned to form a vertical concrete wall of a building. When concrete wall panels are cast in a precast concrete plant for delivery to the building site or are cast on a concrete floor of the building for tilting the panels to form vertical wall panels, the concrete panels are cast with embedded corner or angle strips which are welded to elongated reinforcing bars or members or rebars embedded in the concrete. The steel corner strips are located in the concrete so that when the concrete panels are positioned or tilted upwardly, the corner strips are located in opposing relation on the inside vertical corners of the concrete panels. After the concrete panels are positioned vertically in adjacent relation to form a concrete wall, a flat metal shear connector plate is welded to the opposing metal corner strips for maintaining horizontal alignment and strength to the connected concrete wall panels.

Since a plurality of vertically spaced flat shear connector plates are commonly welded to the opposing corner strips across each vertical joint between adjacent concrete panels, it is necessary for an electric welding person to be elevated to each of the vertically spaced connector plates at each joint where the person is supported by a ladder or a bucket mounted on an arm of a truck or other vehicle. Thus significant time is required for a welding person to be elevated to each connector plate across each joint between adjacent wall panels. Also, at many building sites, it is frequently a problem in obtaining an experienced welding person. In addition, the welded plates form rigid connections between adjacent wall panels at each vertical joint. As a result, when the adjacent concrete panels expand or contract slightly with changes in temperature, it is not uncommon for a weld to break or a metal corner strip to break away from a corner portion of the concrete panel. This sometimes requires the corner strip and corner portion of the concrete panel to be repaired.

General Description of the Preferred Embodiment

The metal shear connector system of the present invention simplifies the construction and installation of adjacent concrete wall panels and overcomes the problems described above in the use of welded shear connector plates by eliminating the time required for welding the shear connector plates to the embedded steel corner strips in adjacent concrete wall panels. The shear connector system also provides for slight movement between adjacent concrete panels in response to thermal expansion and contraction of the adjacent panels.

In accordance with one embodiment of the invention, metal angle corner strips with welded steel threaded studs are embedded in only one corner portion of each concrete wall panel when the panel is cast at the construction site for a tilt-up building or when it is cast at a precast plant. Usually, a plurality of vertically spaced corner strips are embedded in one corner portion of each panel so that the strips are vertically spaced after the panels are positioned vertically as wall panels. Each angle corner strip has a flange with spaced threaded holes for receiving corresponding bolts. The corner strips may also have holes for attaching the strips with nails or screws to the forms used for casting the wall panels.

A substantially flat metal shear connector plate has a set of holes, and one portion of the plate is connected to the flange of the corner connector strip by bolts threaded into a threaded hole or bore within a stud welded to the flange of the connector strip. The threaded hole may also be formed by a nut or a wire coil anchor welded to the flange. The metal connector plate extends across the joint between adjacent concrete wall panels, and the opposite side of the connector plate is secured to the adjacent concrete wall panel by threading self-tapping concrete anchor screws into drilled holes within the adjacent concrete wall panel. Each self-tapping concrete anchor screw extends through an elongated hole or slot within the shear connector plate and provides for thermal expansion and contraction of the connected adjacent concrete wall panels.

Other features and advantages of the invention will be apparent from the following description, the accompanying drawings and the independent claims.

DESCRIPTION OF THE ILLUSTRATED EMBODIMENT

Figure 1:
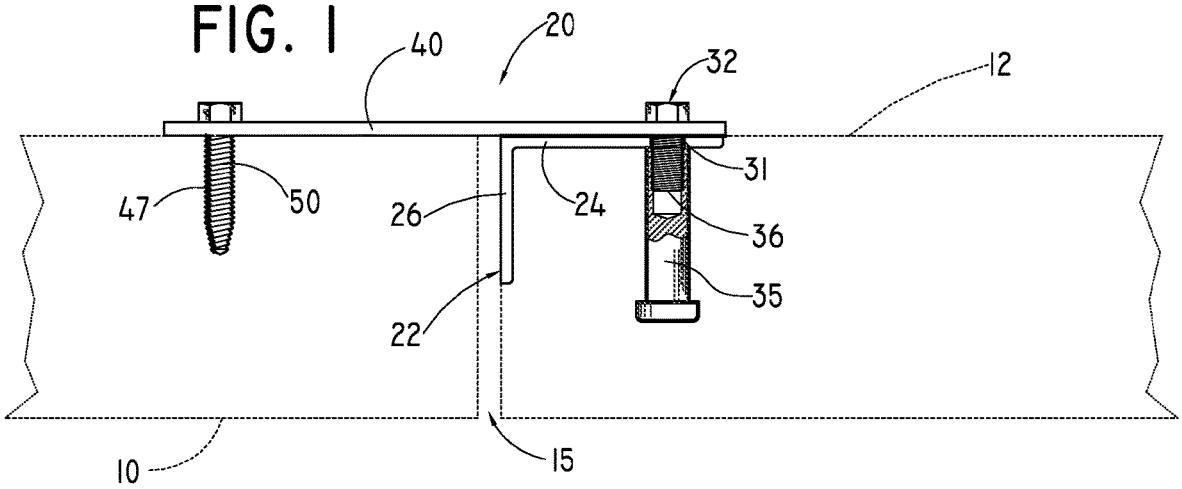
FIG. 1 is a horizontal section of a metal shear connector plate installed across a joint between adjacent concrete wall panels illustrated by broken lines.

FIG. 1 illustrates a horizontal section through two vertical wall panels 10 and 12 which are supported by a foundation in adjacent relation and defining a vertically extending joint 15 between the panels. The width of the joint 15 and the gap or spacing between the adjacent concrete panels usually varies between ¾ inch and one inch depending upon anticipated thermal expansion and contraction of the panels due to changes in temperature. The joint or gap defined between the outside surfaces of the panels 10 and 12 may be filled with a pliable-caulking material or an elastomeric extrusion.

In accordance with the present invention, the inside surfaces of the adjacent concrete panels are connected by a shear connector system or structure 20 at vertically spaced intervals along the height of the panels. Each of the connector structures 20 includes a metal or steel connector member or right angle corner strip 22 which has a flange 24 embedded in the inner surface of the concrete panel 12 and a right angle flange 26 embedded in the end of the concrete panel 12. Two concrete stud members 35 are also embedded in the concrete panel 12 and have outer end portions welded to the flange 26 of the corner strip 22. When the concrete wall panels 12 are cast in a precast plant or on the floor of a tilt-up building, each of the corner strips 22 is positioned within the forms for the panels so that after the concrete cures, each of the corner strips 22 are embedded in the panel as shown in FIG. 1.

Figure 2:
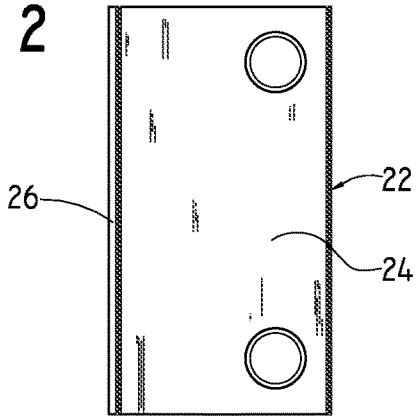
FIG. 2 is an elevational view of a metal corner angle strip shown in FIG. 1.
Figure 3:
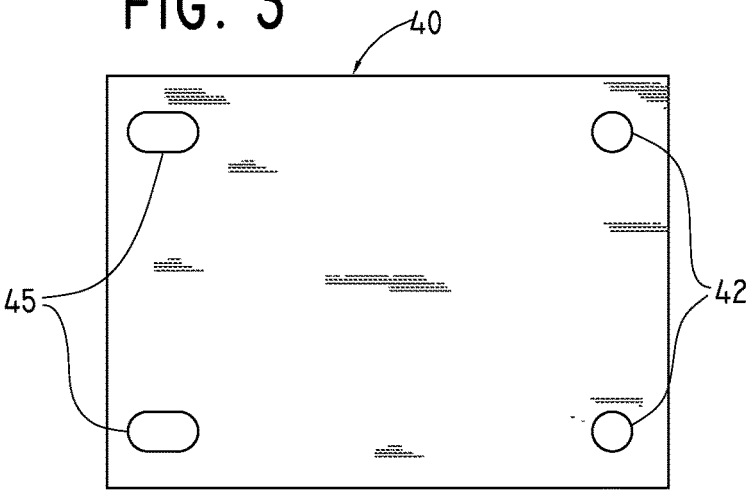
FIG. 3 is a plan view of the metal shear connector plate shown in FIG. 1.
Figure 4:
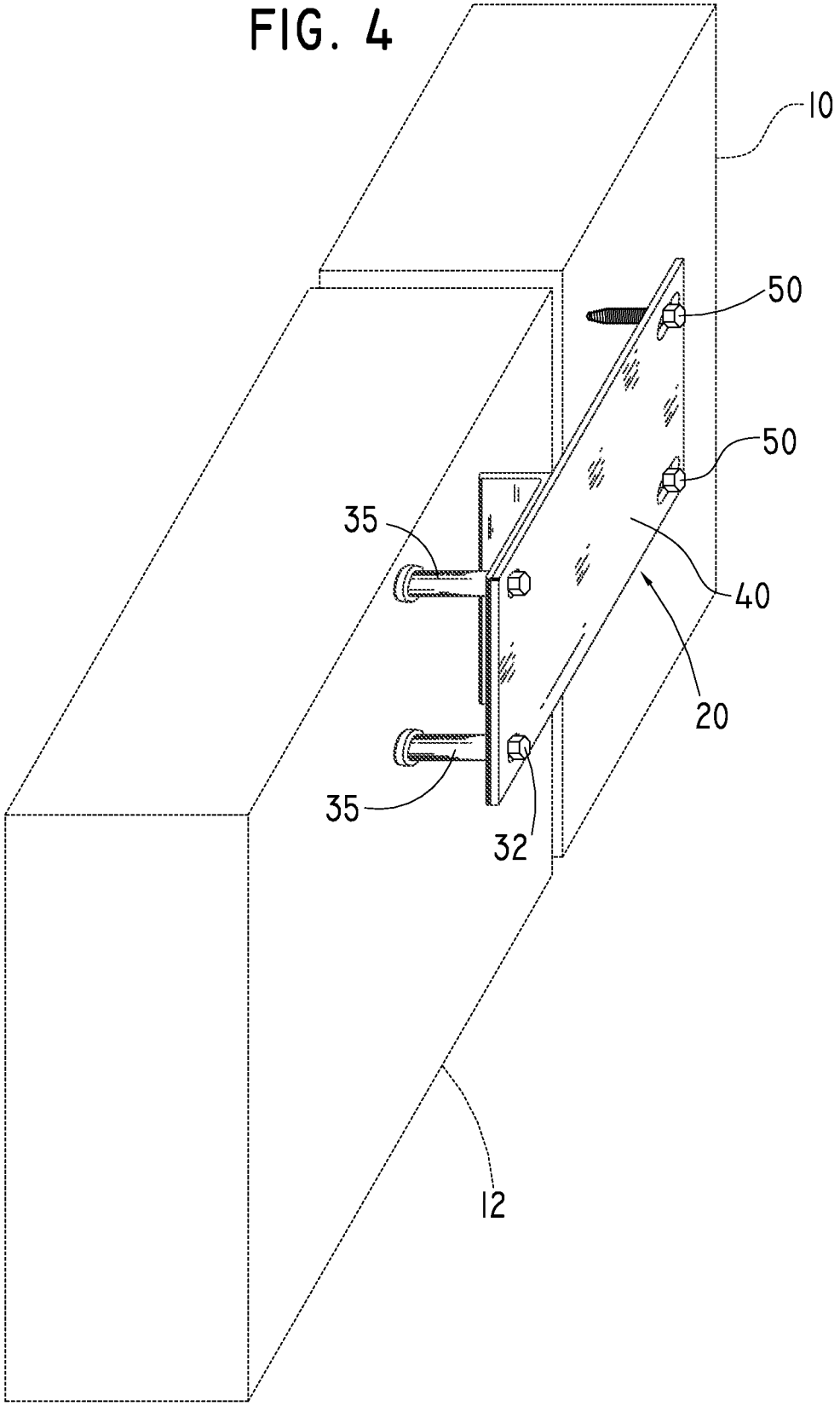
FIG. 4 is a fragmentary perspective view of adjacent concrete wall panels shown by broken lines and a perspective view of an installed metal shear connector plate overlapping a joint between the wall panels and secured to the concrete wall panels in accordance with the invention.
Figure 5:
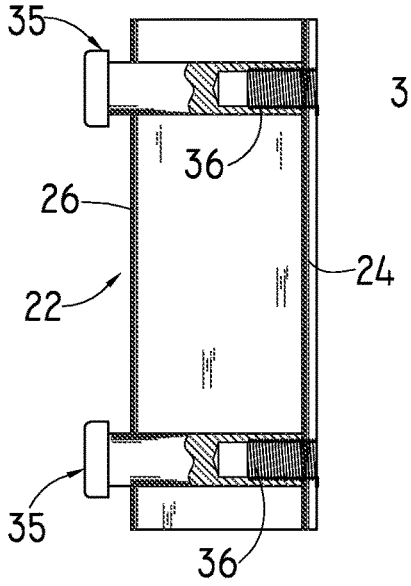
FIG. 5 is an elevational view of a metal corner angle strip with attached studs welded around internally threaded holes or bores within the studs.
Figure 6:
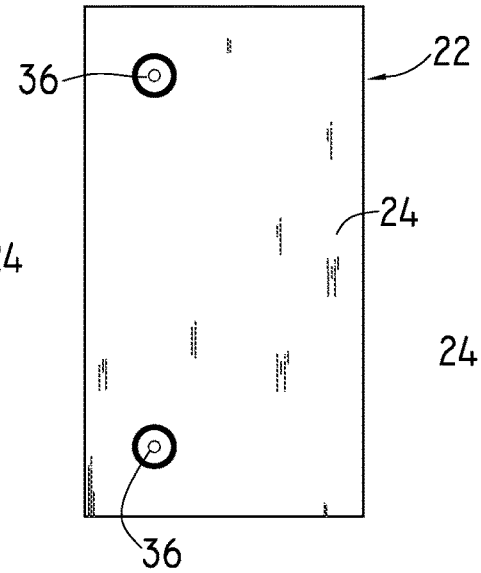
FIG. 6 is an elevational side view of the metal corner angle strip shown in FIG. 5.
Figure 7:
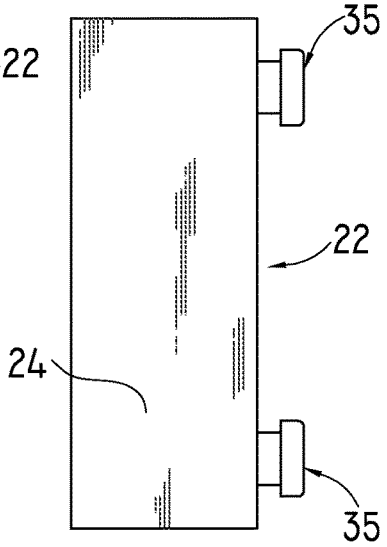
FIG. 7 is another elevational view of the metal corner angle strip shown in FIG. 5.
Figure 8:
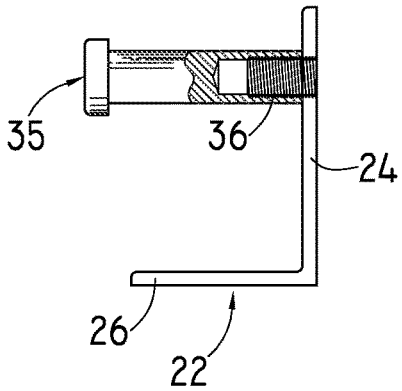
FIG. 8 is an end view of the metal corner angle strip and welded threaded studs shown in FIG. 5.
Figure 9:
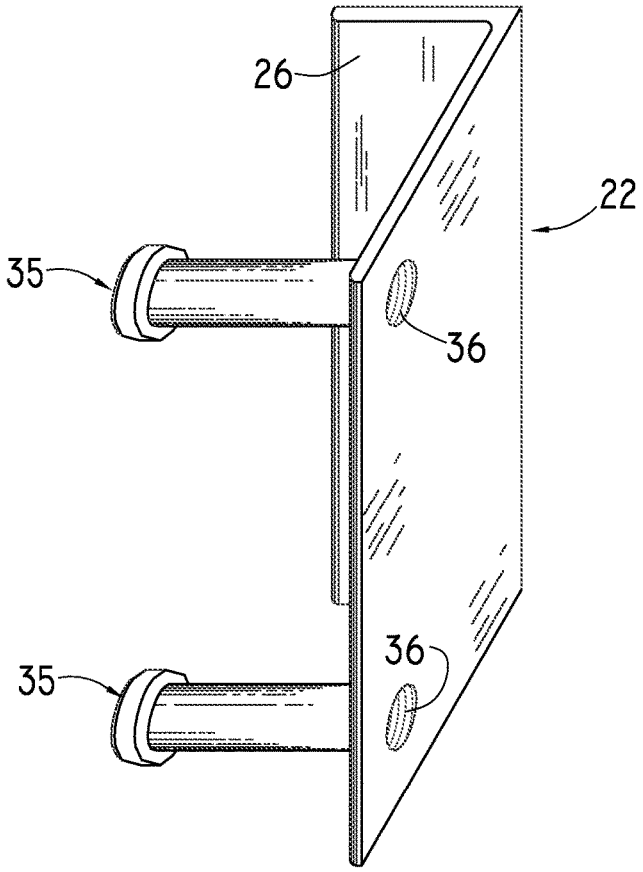
FIG. 9 is a perspective view of the metal corner angle strip and welded studs shown in FIG. 5.

As disclosed in FIGS. 1 and 2 of the above design patent application, the flange 24 of each vertically spaced corner strip 22 is provided with vertically spaced holes 31 for receiving the threaded shank portion of a bolt 32 for receiving a fastener such as a nut or a wire coil bolt welded to the inner surface of the flange 24 in alignment with the hole 31 formed within the flange 24. As shown in above FIGS. 1-9 of this application, each fastener is preferably in the form of a weld stud 35 having an internally thread hole or bore 36 on the end welded to the flange 24 for receiving a bolt 32. Such a stud 35 may be formed by machining a TRU-WELD stud produced by TRU-FIT Products Corporation of Medina, Ohio.

The shear connector structure 20 also includes a substantially flat metal connector plate 40 (FIG. 3) which has a circular hole 42 for receiving each of the fasteners or bolts 32 for securing the connector plate to the flange portion 24 of the angle corner strip 22. The connector plate 40 extends across the joint 15 between adjacent concrete panels 10 and 12, and the opposite end portion of the plate 40 has a plurality of two vertically spaced elongated holes or slots 45. Each slot 45 may have a width of about 1 inch and a length of about 1⅞ inches.

As shown in FIG. 1 after adjacent concrete panels are positioned as vertical wall panels, and positioned where desired, usually with a gap of about ¾ inch to one inch, a hole 47 is drilled into the concrete panel 10 at the center of each slot 45 within the connector plate 40. The holes 47 have a diameter slightly less then the width of the slots 45, and each hole receives a self-tapping concrete anchor screw 50. However, the hole 47 and screw 50 may be positioned anywhere within the slot 45 depending on whether the adjacent concrete panels are likely to expand or contract. The screws 50 are tightened snugly within the holes 47 and with a torque sufficiently light to permit the panel 10 to move slightly relative to the panel 12 and the connector plate 40. Thus, the connector system or structure 20 provides a shear connector with a resistance moment against relative vertical movement between the adjacent panels 10 and 12.

While FIGS. 1-9 disclose the preferred embodiment of applicant's shear connector structure for connecting adjacent concrete wall panels, in some building structures it is possible to eliminate the steel corner angle strips 22 within each panel and replace the bolts or fasteners 32 with an additional set of drilled holes 47 and self-tapping concrete anchor screws 50 for the panel 12. However, while such a shear connector structure would be less expensive to construct and install, the structure would not provide the resistance to relative vertical panel movement between the adjacent panels as provided by the steel angle strips 22 embedded in one corner portion of each concrete wall panel. As also apparent from the drawings and the above description, the shear connector structure of the invention reduces the cost of a shear connector by eliminating a steel corner strip 22 on both inside corners of each concrete wall panel as required when a welded shear plate is welded to both opposing steel corner strips on adjacent concrete panels. The shear connector structure 20 also eliminates the need for an experienced welding person to be positioned or elevated at each of the welded shear connector plates. This reduces the time required to install a plurality of vertically spaced shear connector plates at each joint.

While the shear connector structure for adjacent concrete panels herein described and its method of installing constitute a preferred embodiment of the invention, it is to be understood that the invention is not limited to the precise structure and method disclosed, and that changes may be made therein without departing from the scope of the invention as defined in the appended claims.

What is claimed is:

1. A shear connector structure for connecting a first concrete panel and a second concrete panel in adjacent relation after the panels are set vertically on a concrete support for a building, the shear connector structure comprising a right angle metal connector member embedded in a corner portion of the first concrete panel, a generally flat metal shear connector plate overlapping a joint between the adjacent first concrete panel and the second concrete panel, at least one threaded fastener securing the shear connector plate to the metal connector member, and at least one self-tapping concrete anchor screw extending through at least one hole within the shear connector plate and into at least one drilled hole within the second concrete panel and securing the shear connector plate to the second concrete panel.

2. The shear connector structure of claim 1 wherein the metal connector member is elongated and has a plurality of longitudinally spaced holes, the at least one threaded fastener comprises a plurality of fasteners, the at least one hole of the shear connector plate comprises a plurality of holes for receiving the plurality of threaded fasteners for securing the shear connector plate to the connector member.

3. The shear connector structure of claim 1 wherein the at least hole comprises a plurality of spaced holes within the shear connector plate, the at least one drilled hole comprises a plurality of drilled holes within the second concrete panel, and the at least one self-tapping concrete anchor screw comprises a plurality of the self- tapping concrete anchor screws extending through two of the holes within the shear connector plate and into the drilled holes within the second concrete panel.

4. The shear connector structure of claim 1 wherein the threaded fastener securing the shear connector plate to the connector member provides for pivoting the shear connector plate from a stored position overlapping the first concrete panel to the overlapping joint position after the concrete panels are positioned in adjacent relation.

5. The shear connector structure of claim 1 wherein the hole in the shear connector plate is elongated to define a slot, and the self-tapping concrete anchor screw extends through the slot and into the drilled hole within the second concrete panel.

6. A shear connector structure for connecting a first concrete panel and a second concrete panel in adjacent relation after the panels are positioned vertically on a concrete support for a building, the shear connector structure comprising a generally flat metal shear connector plate overlapping a joint between the adjacent first concrete panel and the second concrete panel, the metal shear connector plate having spaced holes for each of the first concrete panel and the second concrete panel, each of the holes within the metal shear connector plate for the second concrete panel being elongated to define a slot, at least one threaded fastener for each hole within the metal shear connector plate and the corresponding hole within the first concrete panel, each threaded fastener within the first concrete panel comprises a weld stud having an end portion with internal threads and with the end portion welded to the metal shear connector plate, and a self-tapping concrete anchor screw extending through each of the slots within the shear connector plate and into a corresponding hole within the second concrete panel and securing the metal shear connector plate to the second concrete panel.

7. The shear connector structure of claim 6 and including a metal right angle strip member embedded in a corner portion of the first concrete member.

8. The shear connector structure of claim 7 wherein the right angle strip member is elongated and has a plurality of longitudinally spaced holes, and the metal shear connector plate has the spaced holes for the first concrete panel for receiving the threaded fasteners securing the shear connector plate to the right angle strip member.

9. The shear connector structure of claim 6, wherein the holes of the second concrete panel are drilled holes.

* * * * *